US007550697B2

(12) United States Patent
Veselovsky et al.

(10) Patent No.: US 7,550,697 B2
(45) Date of Patent: Jun. 23, 2009

(54) SYSTEMS AND METHODS FOR BORESIGHT ADAPTERS

(75) Inventors: Jeffrey S. Veselovsky, Mesa, AZ (US); Andrew R. Zimmerle, Mesa, AZ (US); Dean Van De Laare, Apache Junction, AZ (US)

(73) Assignee: The Boeing Company, Chicago, IL (US)

( * ) Notice: Subject to any disclaimer, the term of this patent is extended or adjusted under 35 U.S.C. 154(b) by 322 days.

(21) Appl. No.: 11/067,568

(22) Filed: Feb. 25, 2005

(65) Prior Publication Data

US 2009/0114760 A1 May 7, 2009

(51) Int. Cl.

| | |
|---|---|
| ***F41G 11/00*** | (2006.01) |
| ***F41G 1/54*** | (2006.01) |
| *F41G 7/24* | (2006.01) |
| *F41G 1/00* | (2006.01) |

(52) U.S. Cl. ..... 244/3.1; 244/3.11; 244/3.13; 89/1.1; 89/1.11; 250/491.1

(58) Field of Classification Search ..... 244/3.1–3.3; 342/165–174, 62; 89/1.11, 1.8, 1.816, 1.1, 89/41.01–41.22; 33/227, 228, 267, 286; 356/138–153, 399–401; 250/330, 333, 336.1, 250/338.1, 347, 491.1

See application file for complete search history.

(56) References Cited

U.S. PATENT DOCUMENTS

| | | | | | |
|---|---|---|---|---|---|
| 3,628,868 | A | | 12/1971 | Starkey et al. | |
| 3,752,587 | A | | 8/1973 | Myers et al. | |
| 3,923,273 | A | * | 12/1975 | Alpers | 244/3.16 |
| 3,986,682 | A | * | 10/1976 | Dryden | 244/3.17 |
| 3,989,947 | A | * | 11/1976 | Chapman | 244/3.16 |
| 3,992,629 | A | * | 11/1976 | Chapman | 244/3.16 |
| 4,111,383 | A | * | 9/1978 | Allen et al. | 244/3.13 |
| 4,111,384 | A | * | 9/1978 | Cooper | 244/3.13 |
| 4,111,385 | A | * | 9/1978 | Allen | 244/3.13 |
| 4,155,096 | A | * | 5/1979 | Thomas et al. | 244/3.13 |
| 4,173,414 | A | * | 11/1979 | Vauchy et al. | 244/3.16 |
| 4,179,085 | A | * | 12/1979 | Miller, Jr. | 244/3.11 |
| 4,299,360 | A | | 11/1981 | Layton | |
| 4,472,632 | A | * | 9/1984 | Durenec | 250/333 |
| 4,561,775 | A | | 12/1985 | Patrick et al. | |
| 4,581,977 | A | * | 4/1986 | Ross et al. | 89/1.1 |
| 4,737,028 | A | * | 4/1988 | Smith | 244/3.13 |
| 4,776,691 | A | * | 10/1988 | Johnson et al. | 244/3.16 |
| 5,005,973 | A | * | 4/1991 | Mimmack et al. | 356/139.03 |
| 5,052,800 | A | * | 10/1991 | Mimmack et al. | 356/139.03 |
| 5,074,491 | A | * | 12/1991 | Tyson | 244/3.11 |

(Continued)

FOREIGN PATENT DOCUMENTS

| | | | |
|---|---|---|---|
| GB | 2132049 | A * | 6/1984 |

*Primary Examiner*—Bernarr E Gregory

(57) ABSTRACT

Boresighting systems and methods are disclosed. In one embodiment, an assembly adapted for boresighting a launch system includes first and second elongated members adapted to be coupled to the launch system. First and second alignment members are coupled to and extend between the first and second elongated members and are adapted to position the elongated members in a substantially aligned, spaced-apart relationship. A mirror assembly is coupled to each elongated member, the mirror assemblies being adapted to provide an average angular position resulting in a single corrector value for the launch system. In a particular embodiment, each of the first and second elongated members is sized to simulate a Stinger missile.

20 Claims, 4 Drawing Sheets

U.S. PATENT DOCUMENTS 5,106,033 A * 4/1992 Phan ..... 244/3.12
5,129,309 A * 7/1992 Lecuyer ..... 244/3.11
5,149,011 A * 9/1992 Gratt et al. ..... 244/3.19
5,197,691 A * 3/1993 Amon et al. ..... 244/3.13
5,410,398 A * 4/1995 Appert et al. ..... 244/3.13
5,695,152 A * 12/1997 Levy ..... 244/3.13
5,762,290 A * 6/1998 Dupont ..... 244/3.15
5,808,578 A * 9/1998 Barbella et al. ..... 342/62
5,835,056 A * 11/1998 Heap et al. ..... 342/62
6,079,666 A * 6/2000 Hornback ..... 244/3.19
6,525,809 B2 * 2/2003 Perkins ..... 244/3.16
6,587,191 B2 * 7/2003 Greenfield et al. ..... 244/3.13

* cited by examiner

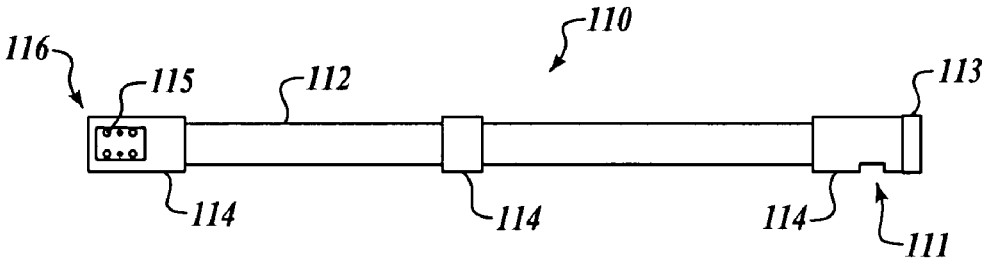
FIG. 3
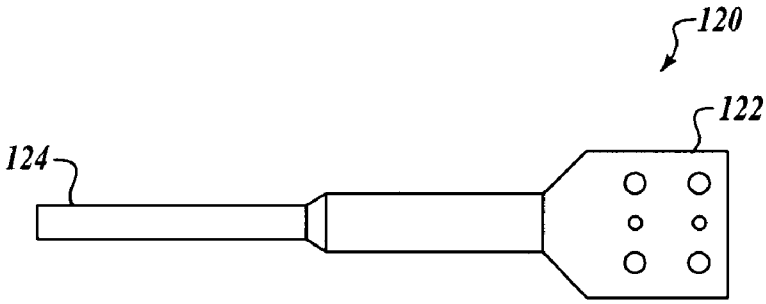
FIG. 4
FIG. 5
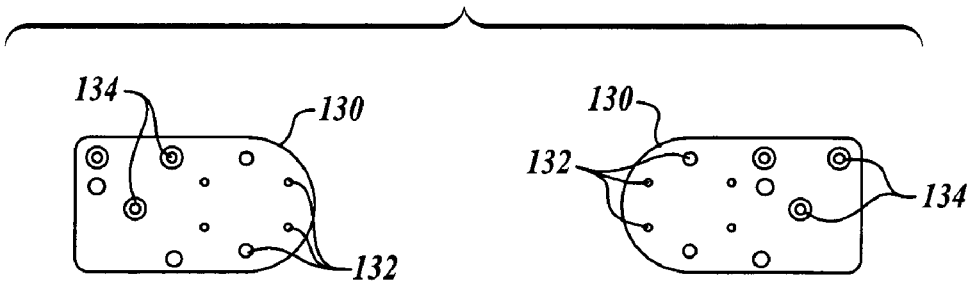

SYSTEMS AND METHODS FOR BORESIGHT ADAPTERS

FIELD OF THE INVENTION

This invention relates to sighting systems, and more specifically, to improved boresighting systems and methods for missile launchers and other suitable devices.

BACKGROUND OF THE INVENTION

Many types of weapons systems require initial and periodic sighting adjustment to ensure accurate operation. Missile launching systems, such as those carried by aircraft, may require occasional sighting adjustment to achieve the accuracy necessary to meet system specifications and customer requirements. For example, the Air-to-Air Stinger missile Launcher (ATAL) deployed on the AH-64D Apache helicopter requires a boresighting procedure to accurately align the missile's seeker with the helicopter's sighting system.

Although desirable results have been achieved using prior art boresighting systems, there is room for improvement. For example, the software of the AH-64D Apache allows only one boresight corrector per wing pylon. The ATAL for the AH-64D, however, has two missiles, requiring that the boresighting procedure be sequentially or iteratively performed, with associated time and expense. Therefore, novel systems and methods that would enable the accurate boresighting of two missiles simultaneously would have utility.

SUMMARY OF THE INVENTION

The present invention is directed to improved boresighting systems and methods for missile launchers and other suitable devices. Embodiments of methods and systems in accordance with the present invention may advantageously allow for boresighting of two devices simultaneously, thereby improving the efficiency of the sighting process, and may also improve the accuracy of the weapon system, in comparison with prior art sighting systems.

In one embodiment, an assembly adapted for boresighting a launch system includes first and second elongated members adapted to be coupled to the launch system. First and second alignment members are coupled to and extend between the first and second elongated members and are adapted to position the elongated members in a substantially aligned, spaced-apart relationship. A mirror assembly is coupled to each elongated member, the mirror assemblies being adapted to provide an average angular position resulting in a single corrector value for the launch system. In a particular embodiment, each of the first and second elongated members includes a substantially-cylindrical body having a plurality of interface locations adapted to be coupled to the launch system, the elongated members being adapted to simulate the size of a Stinger missile.

BRIEF DESCRIPTION OF THE DRAWINGS

Preferred and alternate embodiments of the present invention are described in detail below with reference to the following drawings.

FIG. 3 is a top elevational view of a tube member of the adapter assembly of FIG. 1;

FIG. 4 is a top elevational view of an alignment arm of the adapter assembly of FIG. 1;

FIG. 5 is a front elevational view of first and second brackets of the adapter assembly of FIG. 1;

DETAILED DESCRIPTION

The present invention relates to improved boresighting systems and methods for missiles and other suitable weapons systems. Many specific details of certain embodiments of the invention are set forth in the following description and in FIGS. 1-8 to provide a thorough understanding of such embodiments. The present invention may have additional embodiments, or may be practiced without one or more of the details described for any particular described embodiment.

Figure 1:
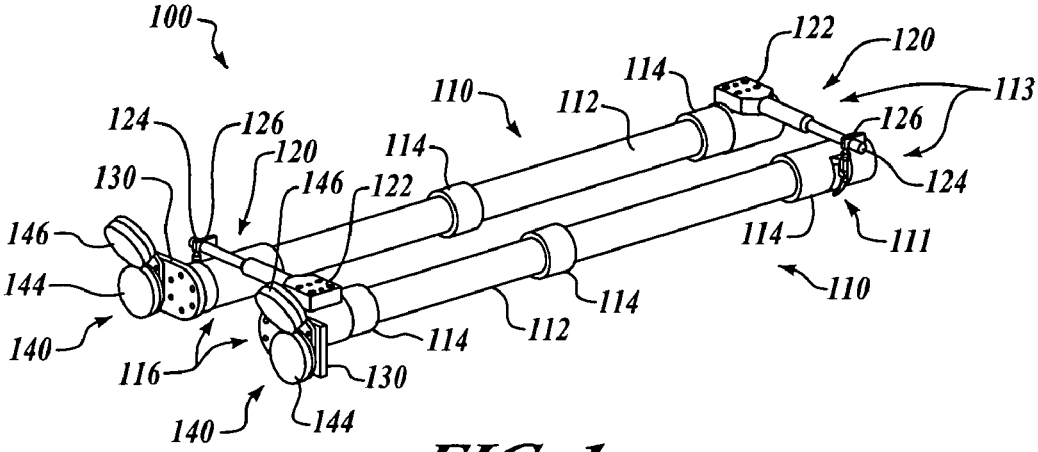
FIG. 1 is an isometric view of an adapter assembly in accordance with an embodiment of the invention.
Figure 2:
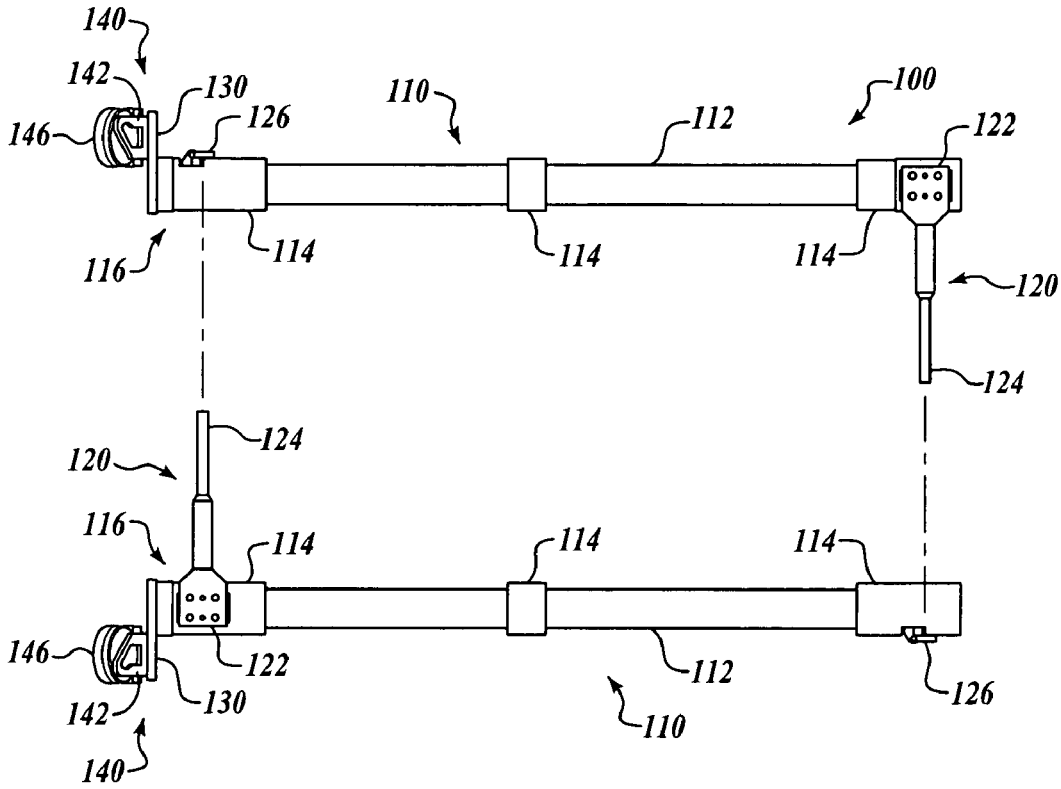
FIG. 2 is a partially-exploded top elevational view of the adapter assembly of FIG. 1.

FIG. 1 is an isometric view of an adapter assembly 100 in accordance with an embodiment of the invention. FIG. 2 is a partially-exploded top elevational view of the adapter assembly 100 of FIG. 1. The adapter assembly 100 includes a pair of tube members 110 and a pair of alignment arms 120 that extend between the tube members 120, maintaining the tube members 120 in a generally aligned relationship. In one particular embodiment, the alignment arms 120 maintain the tube members 120 in an approximately parallel relationship. A bracket 130 is coupled to a forward end 116 of each of the tube members 110, and a mirror assembly 140 is attached to each of the brackets 130.

FIG. 3 is a top elevational view of one of the tube members 110 of the adapter assembly 100 of FIG. 1. In this embodiment, the tube member 110 includes a cylindrical body 112 having a plurality of interface locations 114. As described more fully below, the interface locations 114 are sized to engage with a corresponding plurality of attachment devices of a launch system that is to be calibrated using the adapter assembly 100. As further shown in FIG. 3, a first seating location 111 is disposed proximate a rearward end 113 of the tube member 110, and a second seating location 115 is disposed proximate the forward end 116 of the tube member 110. As best shown in FIGS. 1 and 2, on the other tube member 110, the locations of the first and second seating members 111, 113 are reversed.

FIG. 4 is a top elevational view of one of the alignment arms 120 of the adapter assembly 100 of FIG. 1. In this embodiment, the alignment arm 120 includes an enlarged end 122 adapted to be coupled to the second seating location 113 on the tube member 110 (FIGS. 1 and 2), and a relatively smaller, cylindrical end portion 124 adapted to be coupled to the first seating location 111 by a suitable coupling mechanism 126. In the embodiment shown in FIGS. 1 and 2, the coupling mechanism 126 includes a hook member that engages over the cylindrical end portion 124, clampably attaching the cylindrical end portion 124 to the tube member 110. In one presently preferred embodiment, the alignment arms 120 are machined to tight tolerances and are rigidly secured to the tube members 110 to ensure that the mirror assemblies 140 (FIG. 1) are indexed consistently from installation to installation.

FIG. 5 is a front elevational view of the brackets 130 of the adapter assembly 100 of FIG. 1. Each bracket 130 includes a plurality of first attachment locations 132 (e.g. apertures, threaded holes, etc.) adapted for attaching the bracket 130 to the forward end 116 of the tube member 110, and a plurality of second attachment locations 134 adapted for attaching the corresponding mirror assembly 140 to the bracket 130 using, for example, threaded fasteners or other suitable attachment mechanisms. As best shown in FIGS. 1 and 2, each mirror assembly 140 includes an angled support 142 that is coupled to the bracket 130, and first and second mirrors 144, 146 coupled to the angled support 142. In one particular embodiment, the mirror assembly 140 is a model that is commercially-available from AAI Corporation of Hunt Valley, Md.

Figure 6:
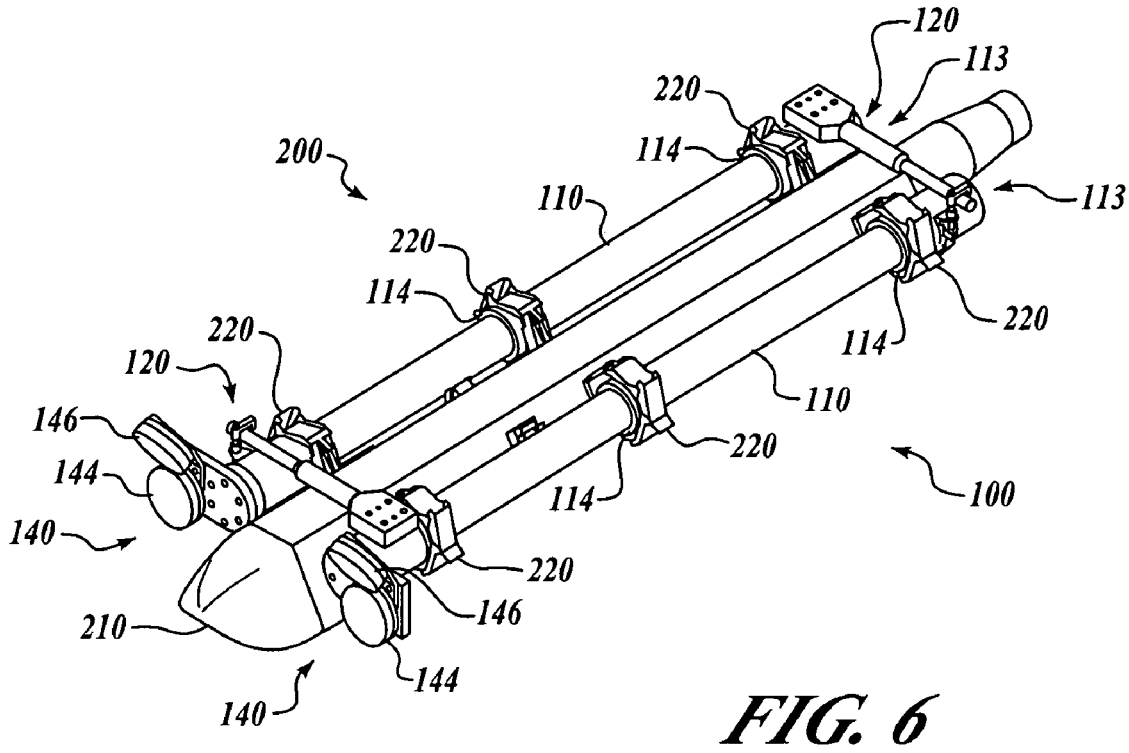
FIG. 6 is an isometric view of the adapter assembly of FIG. 1 engaged with a missile launch system in accordance with another embodiment of the invention.

FIG. 6 is an isometric view of the adapter assembly 100 of FIG. 1 engaged with a missile launch system 200 in accordance with another embodiment of the invention. In this embodiment, the missile launch system 200 includes a base 210 that is adapted to be coupled an aircraft or other suitable launch platform. A plurality of clamps 220 are engaged with the interface locations 114 of the tube members 110, thereby securing the adapter assembly 100 to the missile launch system 200. In one particular embodiment, the missile launch system 200 may be the Air-to-Air Stinger missile Launcher (ATAL) produced by the Raytheon Company's Missile Systems division of Tucson, Ariz. Similarly, in one particular embodiment, the adapter assembly 100, and in particular the tube members 110, are sized and otherwise adapted to simulate the Air-to-Air Stinger missile for purposes of properly boresighting the ATAL missile launch system 200, as described more fully below.

Figure 7:
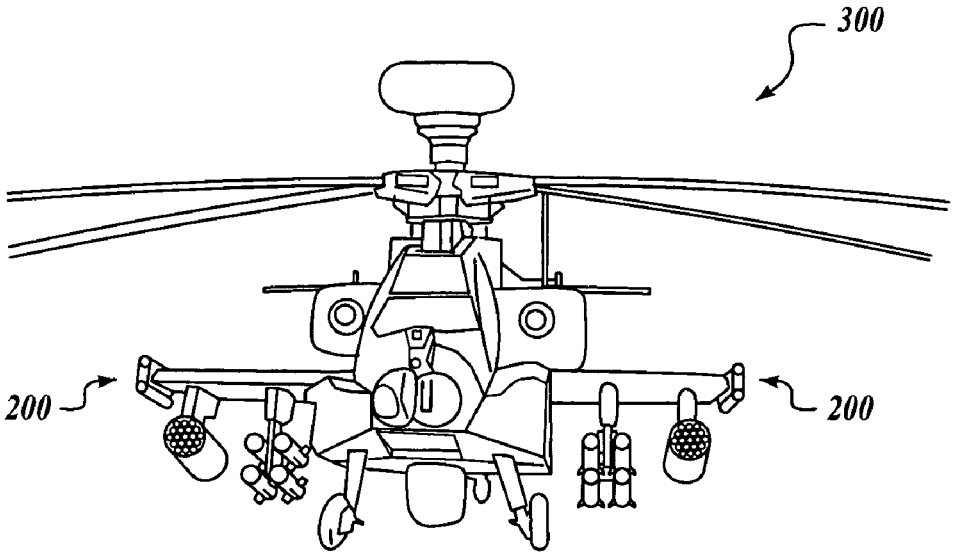
FIG. 7 is a front isometric view of an aircraft having a plurality of missile launch systems of FIG. 6 in accordance with another embodiment of the invention.

The missile launch system 200 may be adapted to be coupled an aircraft or other suitable launch platform. For example, FIG. 7 is a front isometric view of an aircraft 300 having a plurality of missile launch systems 200 of FIG. 6. The missile launch systems 200 may be sighted using the adapter assembly 100 in accordance with the present invention. In the embodiment shown in FIG. 7, the aircraft is an AH-64D Apache helicopter. In alternate embodiments, however, the missile launch systems 200 may be coupled to a variety of different launch platforms, including, for example, the OH-58C, OH-58D, MH-60, AH-1Z, AH-64D, and RAH-66 helicopters, as well as any other suitable manned and unmanned aircraft.

Figure 8:
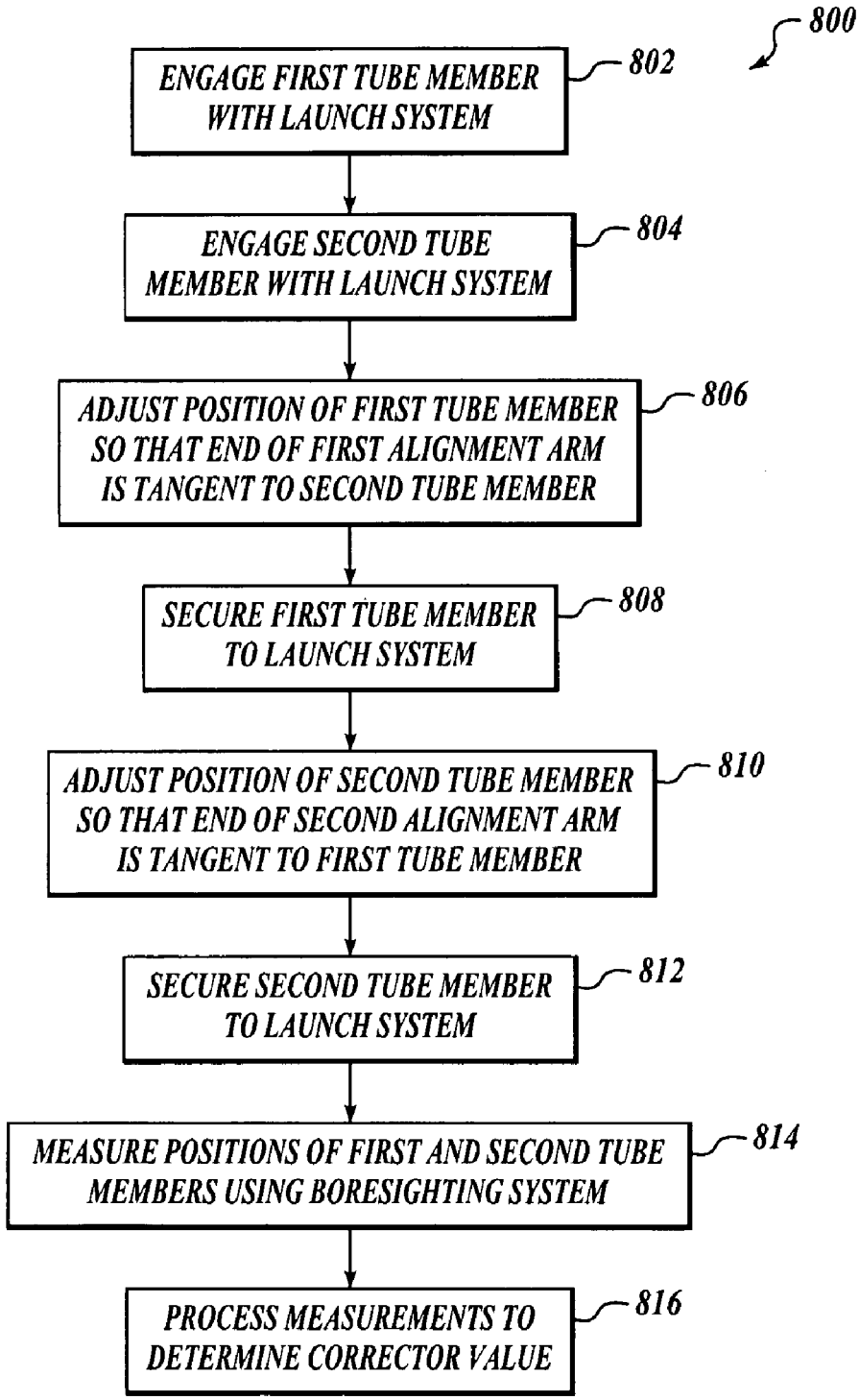
FIG. 8 is a flow diagram of a method of boresighting a launch system in accordance with a further embodiment of the invention.

FIG. 8 is a flow diagram of a method 800 of boresighting a launch system in accordance with a further embodiment of the invention. In this embodiment, the method 800 includes engaging a first tube member of an adapter assembly (e.g. the upper tube member) with a launch system at a block 802. For example, in the case of the ATAL missile launch system 200 (FIG. 6), the upper tube member of the adapter assembly 100 may be placed into the three clamps 220. Similarly, at a block 804, a second tube member (e.g. the lower tube member) is engaged with the launch system. Next, a position of the first tube member is adjusted so that an end portion of a first alignment arm (e.g. end portion 124 of the alignment arm 120 of FIGS. 1-2) is tangent to the second tube member at a block 806. The first tube member is then secured into position on the launch system at a block 808, such as, for example, by securely engaging the clamps 220 of the launch system 200 (FIG. 6). Similarly, at a block 810, a position of the second tube member is adjusted so that an end portion of a second alignment arm is tangent to the first tube member, and the second tube member is then secured into position on the launch system at a block 812.

One or more measurements of the positions of the first and second tube members may then be taken using any suitable boresighting measurement system at a block 814. For example, in various embodiments, the measurements may be obtained using a variety of systems, including, for example, an Advanced Boresighting Equipment (ABE) system available from United Industrial Corporation of Hunt Valley, Md., a Captive Boresight Harmonization Kit (CBHK) available from DRS Technologies of Parsippany, N.J., a Theodolite-based sighting system, or any other suitable measurement systems. In one particular embodiment, measurements of an elevation, azimuth, and roll position are taken for each of the tube members. Finally, at a block 816, the measurements of the positions of the first and second tube members are processed to determine a corrector value for correcting a sighting of the launch system. In a particular embodiment, the position measurements of the first and second tube members are averaged and compared with predetermined desired or calibration values to determine the corrector value, and the correcter value is then provided into a processor of the launch system.

Embodiments of the present invention may provide significant advantages over the prior art. For example, adapter assemblies in accordance with the present invention improve the efficiency of the boresighting process by creating an accurate physical representation of the two missiles to create an average angular position resulting in a single corrector value for the launch system. Thus, the time and expense associated with boresighting the launch system may be considerably reduced in comparison with prior art sighting procedures.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An assembly adapted for boresighting a launch system, comprising:

a measurement system having a processor;

first and second elongated members configured to be coupled to the launch system;

first and second alignment members coupled to and extending between the first and second elongated members and configured to position the elongated members in a substantially aligned, spaced-apart relationship; and a mirror assembly coupled to each elongated member, the mirror assemblies being configured to provide input to the processor, the processor being configured to determine, based on the input, an average angular position resulting in a single corrector value for the launch system, wherein the single corrector value is provided to the launch system for boresighting the launch system.

2. The assembly of claim 1, wherein each of the first and second elongated members includes a substantially-cylindrical body having a plurality of interface locations configured to be coupled to the launch system.

3. The assembly of claim 2, wherein at least one interface location comprises an annular band having a relatively larger diameter than a diameter of an adjacent portion of the substantially-cylindrical body.

4. The assembly of claim 1, wherein each alignment member includes an enlarged end coupled to a first one of the elongated members and a cylindrical end coupled to another of the elongated members.

5. The assembly of claim 1, wherein each mirror assembly includes a first mirror facing a first direction that is substantially parallel with a longitudinal axis of its associated elongated member, and a second mirror facing a second direction that is not parallel with the longitudinal axis.

6. The assembly of claim 5, wherein the first direction intersects the second direction.

7. A missile launch system, comprising:

a base configured to be coupled to a launch platform, the based having a plurality of attachment devices configured to be coupled to at least one missile;

an adapter assembly for sighting the base, the adapter assembly including:

a measurement system having a processor;

first and second elongated members configured to be coupled to the attachment devices of the base;

first and second alignment members coupled to and extending between the first and second elongated members and configured to position the elongated members in a substantially aligned, spaced-apart relationship; and a mirror assembly coupled to each elongated member, the mirror assemblies being configured to provide input to the processor, the processor being configured to determine, based on the input, an average angular position resulting in a single corrector value for the missile launch system, wherein the single corrector value is provided to the launch system for boresighting the launch system.

8. The system of claim 7, wherein each of the first and second elongated members includes a substantially-cylindrical body having a plurality of interface locations configured to be coupled to the launch system.

9. The system of claim 8, wherein at least one interface location comprises an annular band having a relatively larger diameter than a diameter of an adjacent portion of the substantially-cylindrical body.

10. The system of claim 7, wherein each alignment member includes an enlarged end coupled to a first one of the elongated members and a cylindrical end coupled to another of the elongated members.

11. The system of claim 7, wherein each mirror assembly includes a first mirror facing a first direction that is substantially parallel with a longitudinal axis of its associated elongated member, and a second mirror facing a second direction that is not parallel with the longitudinal axis.

12. The system of claim 11, wherein the first direction intersects the second direction.

13. A method of sighting a launch system, comprising:

engaging a first tube member of an adapter assembly with the launch system;

engaging a second tube member of the adapter assembly with the launch system;

adjusting a first position of the first tube member relative to the second tube member;

securing the first tube member into the first position with respect to the launch system;

adjusting a second position of the second tube member relative to the first tube member;

securing the second tube member into the second position with respect to the launch system;

performing measurements of at least one of the first and second positions;

determining a corrector value based on the measurements of the at least one of the first and second positions; and boresighting the launch system using the single corrector value.

14. The method of claim 13, wherein engaging a first tube member of an adapter assembly with the launch system includes engaging an upper tube member of an adapter assembly with the launch system.

15. The method of claim 13, wherein engaging a second tube member of an adapter assembly with the launch system includes engaging an lower tube member of an adapter assembly with the launch system.

16. The method of claim 13, wherein at least one of adjusting a first position of the first tube member and adjusting a second position of the second tube member includes adjusting a position of a one of the tube members so that an end portion projecting outwardly from the one of the tube members is positioned tangent to the other of the tube members.

17. The method of claim 13, wherein at least one of securing the first tube member and securing the second tube member includes securing a plurality of clamps of the launch system.

18. The method of claim 13, wherein performing measurements of at least one of the first and second positions includes performing measurements of both the first and second positions.

19. The method of claim 13, wherein performing measurements of at least one of the first and second positions includes performing measurements of at least one of an elevation value, an azimuth value, and a roll value.

20. The method of claim 13, wherein determining a corrector value based on the measurements of the at least one of the first and second positions includes at least one of averaging the measurements and comparing the measurements with a predetermined value to determine the corrector value.

* * * * *